US006158056A

United States Patent [19]

Riley

[11] Patent Number: 6,158,056

[45] Date of Patent: Dec. 12, 2000

[54] FIREPROOF PANTS WITH DETACHABLE BOTTOM LEG SECTIONS

[76] Inventor: John T. Riley, 2611 N. Charlotte St., Pottstown, Pa. 19464

[21] Appl. No.: 09/333,457

[22] Filed: Jun. 15, 1999

[51] Int. Cl.[7] ..... A41D 27/10

[52] U.S. Cl. ..... 2/269; 2/79; 2/81

[58] Field of Search ..... 2/269, 79, 81, 2/227, 270

[56] References Cited

U.S. PATENT DOCUMENTS

| | | | |
|---|---|---|---|
| 269,479 | 12/1882 | Stretch et al. | 2/269 |
| 1,545,499 | 7/1925 | Kosofsky | 2/269 |
| 4,766,613 | 8/1988 | Wells | 2/227 |
| 4,782,534 | 11/1988 | Grilliot et al. | 2/269 |
| 5,088,116 | 2/1992 | Gould | 2/82 |
| 5,153,944 | 10/1992 | Teel | 2/279 |
| 5,473,780 | 12/1995 | Zen | 2/79 |
| 5,717,999 | 2/1998 | Lurry | 2/69 |
| 5,774,892 | 7/1998 | Tisdale et al. | 2/69 |
| 5,802,611 | 9/1998 | McKenzie et al. | 2/69 |
| 5,819,320 | 10/1998 | Jolla | 2/236 |
| 5,926,851 | 7/1999 | Kovalik | 2/227 |

*Primary Examiner*—Bibhu Mohanty
*Attorney, Agent, or Firm*—Henderson & Sturm LLP

[57] ABSTRACT

A revision to the standard fireproof garments currently worn by race car drivers and pit crew people that allows the wearer to remove the bottom section of the pants to cool off when not in the car or in an area where protection from possible fire is not required. The top and bottom sections of the pants secure through use of hook and loop fasteners designed to withstand extremely high temperatures. The top section features a stretchy material at the lower end that hugs the leg to prevent any extreme heat from going up the leg opening. The bottom section slides up over the stretchy portion and secures to the top section via the hook and loop fasteners. The bottom section features a cuff or fold that folds over the secured two sections to hide the seam. Also, cooperating snap button elements are located on the top and bottom sections to allow for quick alignment by the user.

2 Claims, 1 Drawing Sheet

FIREPROOF PANTS WITH DETACHABLE BOTTOM LEG SECTIONS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of garments, and more particularly to garments having detachable components.

2. Description of the Related Art

As can be seen by reference to the following U.S. Pat. Nos. 5,473,780; 5,717,999; 5,774,892; 5,802,611; and 5,819,320 the prior art is replete with myriad and diverse garments with detachable components.

While all of the aforementioned prior art constructions are more than adequate for the basic purpose for which they have been specifically designed, they are uniformly deficient with respect to their failure to provide a simple, efficient, practical fireproof garment having detachable components.

Race car drivers and pit crew members lose a large quantity of body fluids during a racing event and intake of liquids does not make up for this loss. It is desirable to take all reasonable steps to assist the drivers and pit crew members in retaining body fluids. Retaining body fluids reduces fatigue and helps the drivers and pit crews remain at a high state of alertness. Keeping cool, reducing body fluid losses, and allowing the body to breath reduces the chance of being affected by heat prostration or heat exhaustion which can debilitate an individual or in extreme cases cause death.

Driving suits and pit crew suits are extremely warm due to the fireproof requirement of the suits and the thickness of the suit. During times when the driver has to wait and is fully outfitted, the driver is very hot and uncomfortable. Normally, the driver or pit crew member can remove the jacket of the outfit if it is a two-piece or he can unzip and pull the top of a one-piece suit down. But the pants have to remain on since the driver or pit crew members are only in underwear or body stocking under the suit.

As a consequence of the foregoing situation, there has existed a need for a new and improved modular fireproof garment suitable for use by race car drivers and the provision of such a construction is a stated objective of the present invention.

BRIEF SUMMARY OF THE INVENTION

Briefly stated, the present invention provides a revision to the standard fireproof garments currently worn by race car drivers and pit crew people that allows the wearer to remove the bottom section of the pants to cool off when not in the car or in an area where protection from possible fire is not required. The top and bottom sections of the pants secure through use of hook and loop fasteners designed to withstand extremely high temperatures. The top section features a stretchy material at the lower end that hugs the leg to prevent any extreme heat from going up the leg opening. The bottom section slides up over the stretchy portion and secures to the top section via the hook and loop fasteners. The bottom section features a cuff or fold that folds over the secured two sections to hide the seam. Also, cooperating snap button elements are located on the top and bottom sections to allow for quick alignment by the user.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
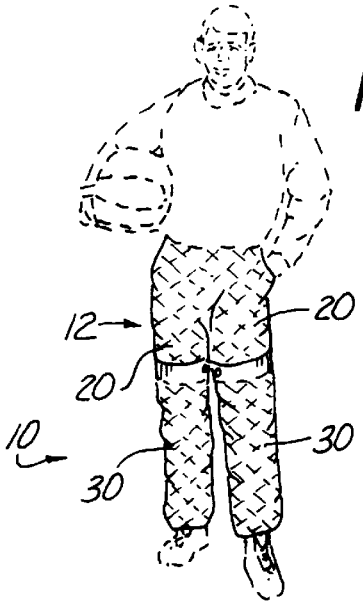
FIG. 1 is a perspective view of the fireproof pants of the present invention being worn by a race car driver.
Figure 2:
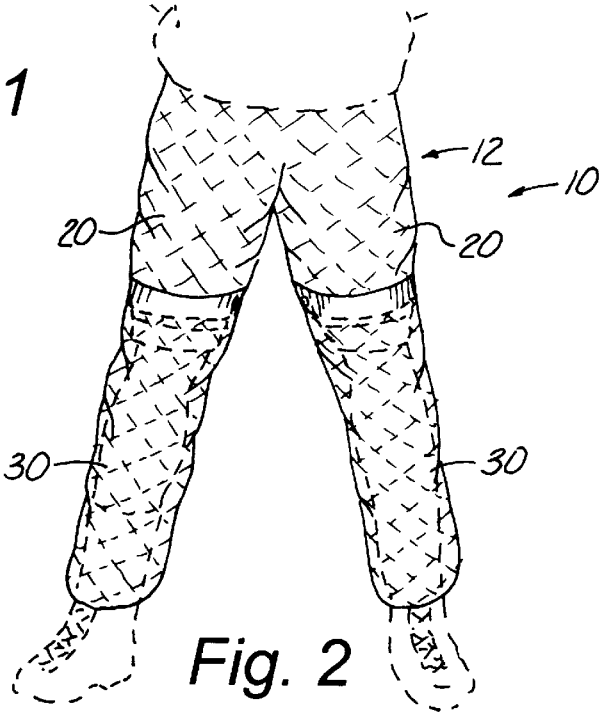
FIG. 2 is an enlarged partial perspective view of the pants with the top and bottom leg sections attached.
Figure 3:
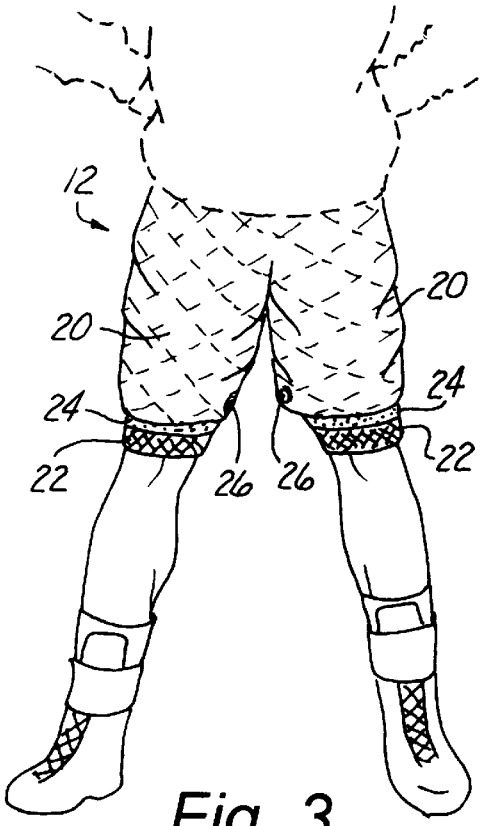
FIG. 3 is an enlarged partial perspective view of the pants with the bottom leg sections removed.
Figure 4:
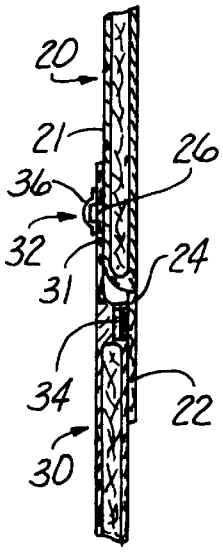
FIG. 4 is a sectional view illustrating the attachment of the top and bottom leg sections.

As can be seen by reference to the drawings, and in particulary to FIG. 1, the pants or garment that forms the basis of the present invention is designated generally by reference number (10). Conceptually speaking, the garment is a pair of pants (10) with top leg sections (20) and removable bottom leg sections (30) that are part of a race car driver's driving suit.

Figure 5:
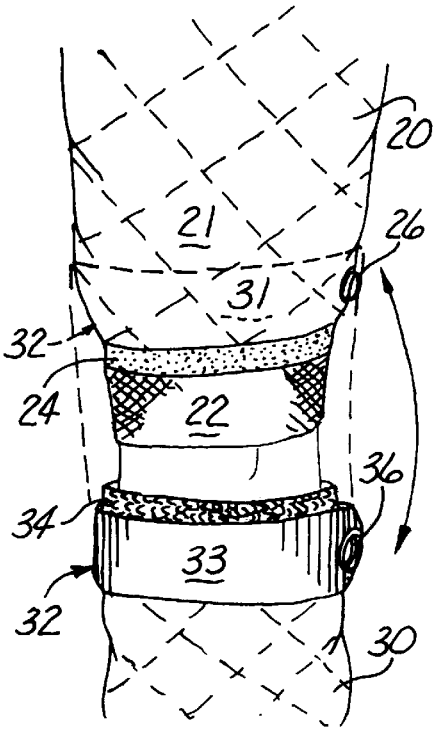
FIG. 5 is a greatly enlarged partial perspective view with a full line illustration of the top and bottom leg sections detached, and a dashed line illustration of the top and bottom sections attached.

The pants (10) come in two pieces; the shorts (12) including the top leg sections (20) and the detachable bottom legs (30). The pants (10) are made from a fireproof fabric such as Nomex®. To prevent the top legs (20) from creeping up, there is a 3" (7.62 cm) high band (22) of elasticized material at the lower edge of each of the top leg sections (20). Attached to the top of this elasticized band (22) is a strip of hook and loop fastener (24). The fastener (24) could, for example, possess fireproof/fire-resistant and flame retardant properties. A snap fastener element (26) is carried on each of the top leg sections (20) above the fastener (24). Attached to the inside of each of the removable bottom leg sections (30) is a mating hook and loop fastener (34). The fastener (34) is located 3" (7.62 cm) below the top edge of the removable bottom leg section (30). The 3" (7.62) cm section above the fastener (34) forms a collar (32) having an inner face (33) which is rolled up onto the top leg section (30) (FIG. 5 dashed lines) to cover the attached hook and loop fasteners (24), (34) to simulate a one-piece leg. A complementary snap fastener element (36) is carried on the inner face (33) of the collar (32). The outer face (31) of the collar (32) folds up when attached to blend in with the outer face (21) of the top leg (20).

Sizes of the pants (10) would conform to regular driving uniform sizes. The outside diameter of the short's elasticized band (22) and the inside diameter of the top 3" (7.62 cm) collar section (32) of the removable bottom legs (30) are a slip fit. The slip fit of the roll up collar (32) maintains the flowing line of the fabric to make it look like a one-piece pair of pants.

The main feature of the pants (10) is the removable legs (30) of pants (10) and the ability of the user to convert the pants (10) into a pair of shorts (12), thus allowing the user to cool down. The suit would be manufactured according to the specifications set by the organization that approves and sanctions this type of body wear for race car drivers and pit crew members. The hook and loop fasteners (24), (34) ensure quick and easy removal and attachment of the bottom leg sections (30). For easy alignment of the two pieces, the top and bottom leg sections (20), (30) are equipped with snap fasteners (26), (36) which are located on the outside of the top leg section (20) and on the inside of the bottom leg collar (32).

The pants (10) would be made from NOMEX® fabric including the elasticized legs (22). The pants (10) could be manufactured by employing standard and special garment sewing and manufacturing techniques as employed by companies specializing in the manufacture of racing suits. The NOMEX® fabric, developed by DuPont for applications requiring dimensional stability and excellent heat resistance, is available in fiber form and sheet form. NOMEX® fabric products are used in protective apparel, hot gas filtration, automotive hoses, electrical insulation, aircraft parts, and sporting goods. NOMEX® fibers do not flow or melt upon heating. Decomposition and charring does not proceed at a significant rate until well over 350° C.—without melting. NOMEX® fabric is both chemically and thermally very stable. General features include heat and flame resistance, high ultraviolet resistance, high chemical resistance, and low thermal shrinkage.

The hook and loop fasteners (34, 34) for the connection of the bottom leg section (30) to the top section (20) can be any one of the following: VELCRO® products: HI-GARDE® brand hook and loop fastener is an all steel, heat and corrosion resistant product that can be used in conditions up to 800 degrees F.; and MID-TEMP® brand hook and loop fastener is a combination of NOMEX® yarn and non corrosive metal usable up to 450 degrees F.; and HI-AIR® brand hook and loop fastener is flame retardant and is specially woven from NOMEX® yarn to meet and exceed FAA requirements.

Alternate embodiments of the present invention include use of NOMEX® self-healing zippers that are blind stitched into the inside of the collar (32) and the outside of the shorts leg section (20). The zippers would ensure a complete seal of the top and bottom leg sections (20, 30), and the entire suite (10) would retain its fireproof capabilities.

Another variation could consider attaching the cuff (32) to the shorts (12) rather than on the removable legs (30). This way, the cuff (32) would protect the joint area and would shed liquids.

Still another variation includes adding VELCRO® tabs to the bottom edge of the bottom leg sections (30) to seal off the pant leg. This will prevent the flow of heat from a fire from going up the pant leg at the extreme bottom.

Consideration could also be given to a variation that has a quilted fire-heat resistant lining.

Finally, another possible variation could be removable jacket sleeves of one-piece suits which would function similar to the pants legs (30).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A garment, comprising:

a pants portion including a pair of top leg sections and a pair of bottom leg sections;

each top leg section having a lowermost edge formed of a band of elastic material adapted to tightly encircle a leg of a user, a first strip of hook or loop fastener disposed above the band, and a first snap fastener disposed above the strip; and each bottom leg section having an uppermost edge formed of a collar including an outer face and an inner face, a second strip of loop or hook fastener disposed below the inner face of the collar, and a second snap fastener disposed on the inner face of the collar.

2. The garment of claim 1 wherein the pants portion is formed of a fire resistant material.

* * * * *